US009138043B1

(12) United States Patent
Meier

(10) Patent No.: US 9,138,043 B1
(45) Date of Patent: Sep. 22, 2015

(54) UNIVERSAL CONTAINER HOLDER AND MEANS FOR APPLICATION

(71) Applicant: Virgil B. Meier, Freeport, IL (US)

(72) Inventor: Virgil B. Meier, Freeport, IL (US)

( * ) Notice: Subject to any disclaimer, the term of this patent is extended or adjusted under 35 U.S.C. 154(b) by 249 days.

(21) Appl. No.: 13/888,510

(22) Filed: May 7, 2013

(51) Int. Cl.
*A46B 5/02* (2006.01)
*A45F 5/10* (2006.01)

(52) U.S. Cl.
CPC ..... *A45F 5/10* (2013.01)

(58) Field of Classification Search
CPC ..... A45D 2200/1081; A61M 35/003
USPC ..... 401/6, 48; 248/102, 103, 106, 315, 248/309.1, 311.2, 311.3; 604/36, 310
See application file for complete search history.

(56) References Cited

U.S. PATENT DOCUMENTS

| | | | | |
|---|---|---|---|---|
| 1,641,531 | A * | 9/1927 | Corcoran | 248/103 |
| 1,681,592 | A * | 8/1928 | Miller et al. | 222/267 |
| 4,396,028 | A | 8/1983 | Waggoner | |
| 5,240,339 | A | 8/1993 | DeForest et al. | |
| 5,671,497 | A | 9/1997 | Abdo | |
| 5,897,150 | A | 4/1999 | Rubini | |
| 6,009,887 | A * | 1/2000 | Hertel | 132/317 |
| 6,045,279 | A | 4/2000 | Follis | |
| 6,530,707 | B1 | 3/2003 | Byrne et al. | |
| 7,219,386 | B2 | 5/2007 | Tsuchiya et al. | |
| 2006/0008313 | A1 | 1/2006 | Wisniewski | |
| 2009/0003917 | A1 * | 1/2009 | Duncan | 401/6 |
| 2009/0159487 | A1 | 6/2009 | Tacoma | |
| 2012/0211532 | A1 | 8/2012 | Santos | |

* cited by examiner

*Primary Examiner* — Jennifer C Chiang
(74) *Attorney, Agent, or Firm* — Robert C. Montgomery; Montgomery Patent & Design, LP.

(57) ABSTRACT

A container holder for applying material from a container to hard to reach areas of a user's body is disclosed. The container holder includes an elongated handle with a hand grip and a pivoting assembly with a thumbscrew adjustable clamping mechanism for holding the container. A user secures a container within the adjustable clamping mechanism using the thumbscrew, positions the container at a desired angle, locks the pivoting assembly relative to the handle, and applies material from the container to areas which are difficult to reach.

18 Claims, 3 Drawing Sheets

UNIVERSAL CONTAINER HOLDER AND MEANS FOR APPLICATION

RELATED APPLICATIONS

There are no current co-pending applications.

FIELD OF THE INVENTION

The present invention is directed to container holders. More particularly, the present invention relates to contain holders for applying lotions and ointments to hard to reach places.

BACKGROUND OF THE INVENTION

The human body is for the most part a miraculous structure where fit and function are intertwined to support a productive life. Frustratingly, as good as it is the human body does have those out of reach areas that just cannot be accessed. No matter how much effort is put into it there are just some places where lotions, body oils, suntan protection, salves, creams, topical ointments, surfactants and the like just cannot be directly applied. In addition there are things such as shoe polish, lint removers and such that while not applied directly to the body are nonetheless at times difficult to use. Age and infirmities do not help these matters.

Many of the lotions, creams, topical ointments, and other items are provided in either roll-on style containers or sponge-tip applicators. While such containers have proven to be very useful they do require direct access to targeted areas. The obvious solution to the application of hard to reach places is to have another person apply them. While this type of application is often used and very effective, it is not a viable solution to those living alone or those living only with the very young, very old, or infirmed. In addition, requiring the assistance of another reduces the highly independent nature of the elderly or disabled. As a result, many go without properly applying needed medications and compounds to their hard or impossible to reach places, possibly resulting in serious detriment to their comfort and health.

Accordingly, there is a need for devices by which an individual can quickly and easily apply roll-on style or sponge-tip applied topical ointments, liquids, and compounds to their back or other hard-to-reach areas. Preferably such devices would permit a user to apply lotions, oils, medicines, creams and the like as needed. Ideally such devices would be useable by the elderly, disabled, and those living alone, would be easy and comfortable to use, would be suitable for use with a wide range of containers, permit compounds to be applied in different directions, and could be used without tools.

SUMMARY OF THE INVENTION

The principles of the present invention provide for a device by which an individual can quickly and easily apply roll-on style or sponge-tip applied liquids and compounds to their back and other hard-to-reach areas. The device permits a user to apply lotions, oils, medicines, creams and the like as needed. The device is easy to use, comfortable, and suitable for use by the elderly, disabled, and those living alone. The device can be used to apply compounds from a wide range of containers without the need for tools.

A container holder that is in accord with the present invention includes an elongated handle having a first end and a rectangular cross-sectioned second end. A cylindrical hand grip is attached to the first end. The container holder also includes a pivot fastener and a pivoting head assembly having a body. The body includes a rectangular slot defined by a first leg and by a second leg and a concave saddle surface opposite the rectangular slot. There is a clamp attached to the body within the saddle. The pivot fastener passes through the first leg, the second leg, and the second end, thereby attaching the pivoting head assembly to the handle. If the pivot fastener is loose the pivoting head can pivot, but if the pivot fastener is tight the pivoting head is locked in position relative to the handle.

In practice the handle should be approximately two feet (2 ft.) long; the hand grip includes closed-cell urethane foam and is adhesively bonded to the handle. The handle itself beneficially includes aluminum. Preferably the pivoting head assembly can pivot one-hundred eighty degrees (180°) relative to the handle while clamp is screwed onto the body. The clamp is beneficially comprised of a clamp strap; a clamp screw housing that is attached to one (1) end of the clamp strap while receiving the other end of the clamp strap. The clamp also includes a thumb screw for tightening the clamp strap. Preferably the clamp strap extends along the saddle while the pivot fastener operates by selectively causing the first leg and the second leg to pinch the second end when tightened. To that end there is a wing nut attached to the pivot fastener.

Another container holder that is in accord with the present invention includes an elongated handle having a first end and a rectangular cross-sectioned second end. A foam hand grip is attached to the first end. The container holder also includes a screw pivot fastener having a wing nut and a pivoting head assembly having a body. The body includes a rectangular slot defined by a first leg and by a second leg and a concave saddle surface opposite the rectangular slot. There is a clamp that extends along the saddle surface which is attached to the body at the saddle surface. The pivot fastener passes through the first leg, the second leg, and the second end, thereby attaching the pivoting head assembly to the handle. If the wing nut is loose the pivoting head can pivot, but if the wing nut is tight the pivoting head is locked in position relative to the handle.

In practice the handle should be approximately two feet (2 ft.) long; the hand grip includes closed-cell urethane foam and is adhesively bonded to the handle. The handle itself beneficially includes aluminum. Preferably the pivoting head assembly can pivot one-hundred eighty degrees (180°) relative to the handle while clamp is screwed onto the body. The clamp is beneficially comprised of a clamp strap; a clamp screw housing that is attached to one (1) end of the clamp strap while receiving the other end of the clamp strap. The clamp also includes a thumb screw for tightening the clamp strap. Preferably, the pivot fastener operates by selectively causing the first leg and the second leg to pinch the second end when tightened.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

Figure 1:
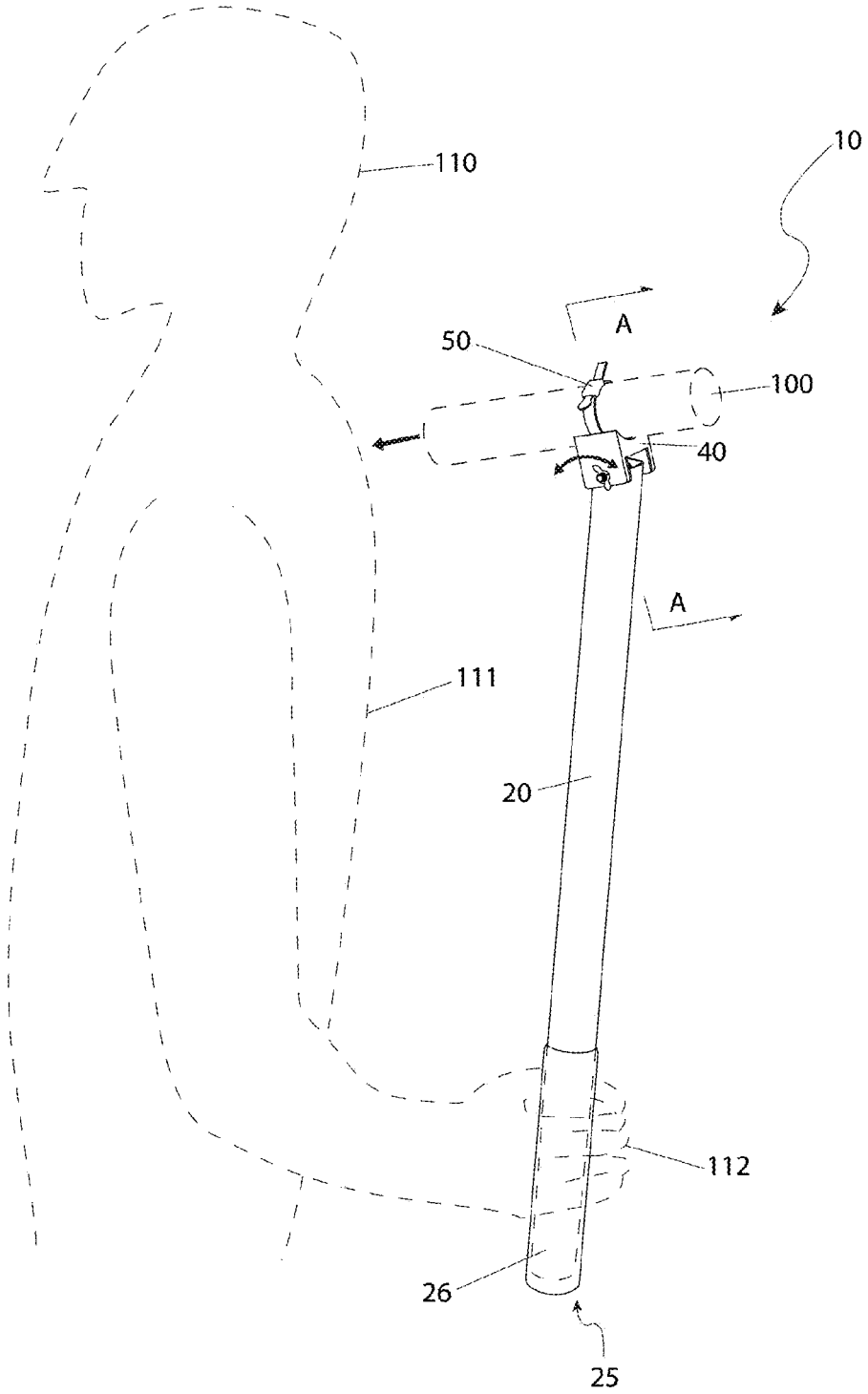
FIG. 1 is an environmental view of an in-use container holder 10 that is in accord with a preferred embodiment of the present invention.

10 container holder
20 handle
22 upper end
24 first fastener aperture
25 lower end
26 hand grip
40 pivoting head assembly
41 pivot body
42*a* first leg
42*b* second leg
43 slot
44 friction pads
46 second fastener aperture
48 saddle feature
50 clamp
51 clamp strap
52 clamp screw housing
54 thumb screw
80 clamp fastener
81 pivot fastener
82 wing nut
100 container
105 fluid
110 user
111 back
112 hand

DETAILED DESCRIPTION OF THE PREFERRED EMBODIMENT

Figure 2:
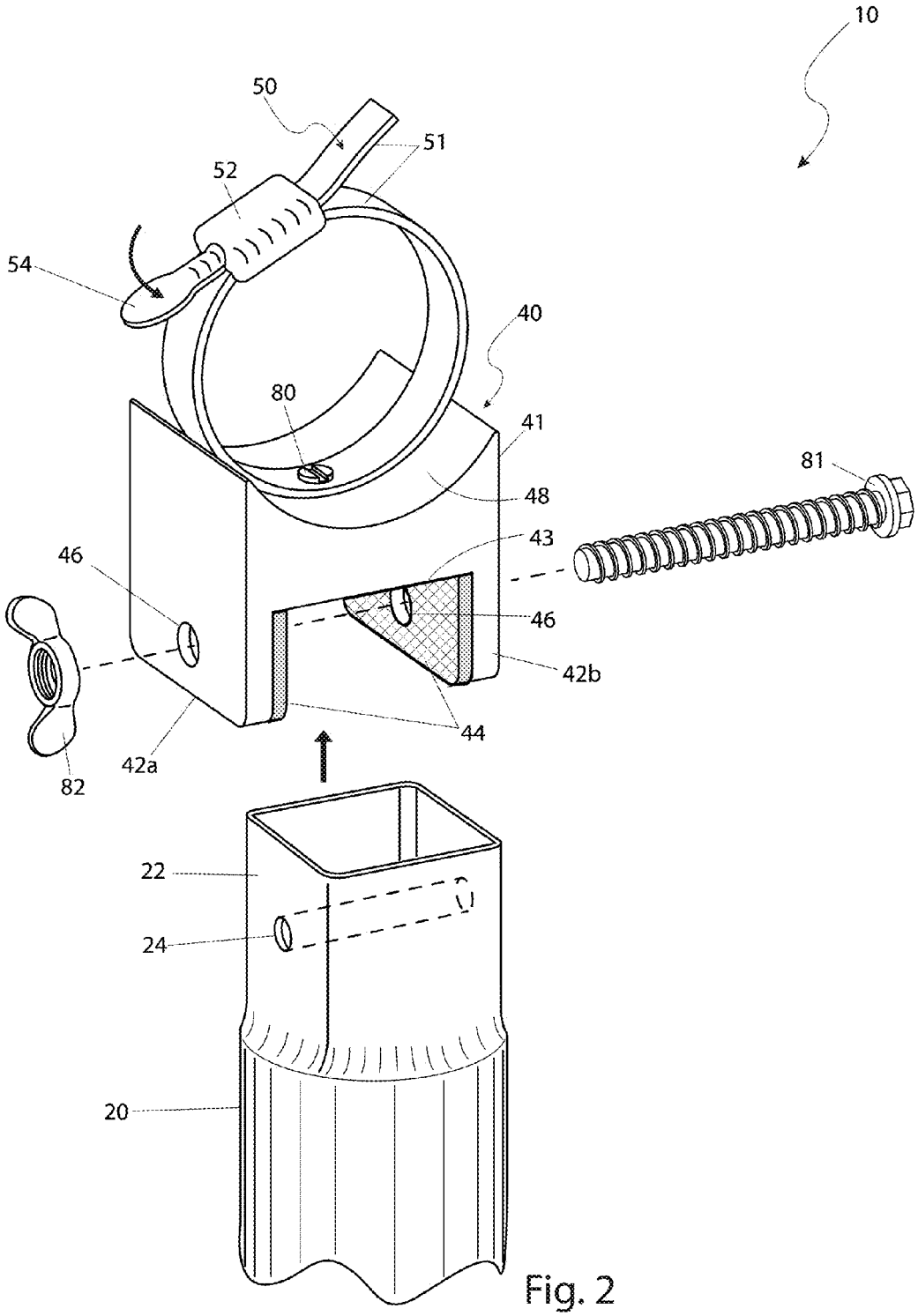
FIG. 2 is an exploded view of a pivoting head assembly 40 of the container holder 10 shown in FIG. 1; and, FIG. 3 is a section view of the container holder 10 taken along section line A-A of FIG. 1.
Figure 3:
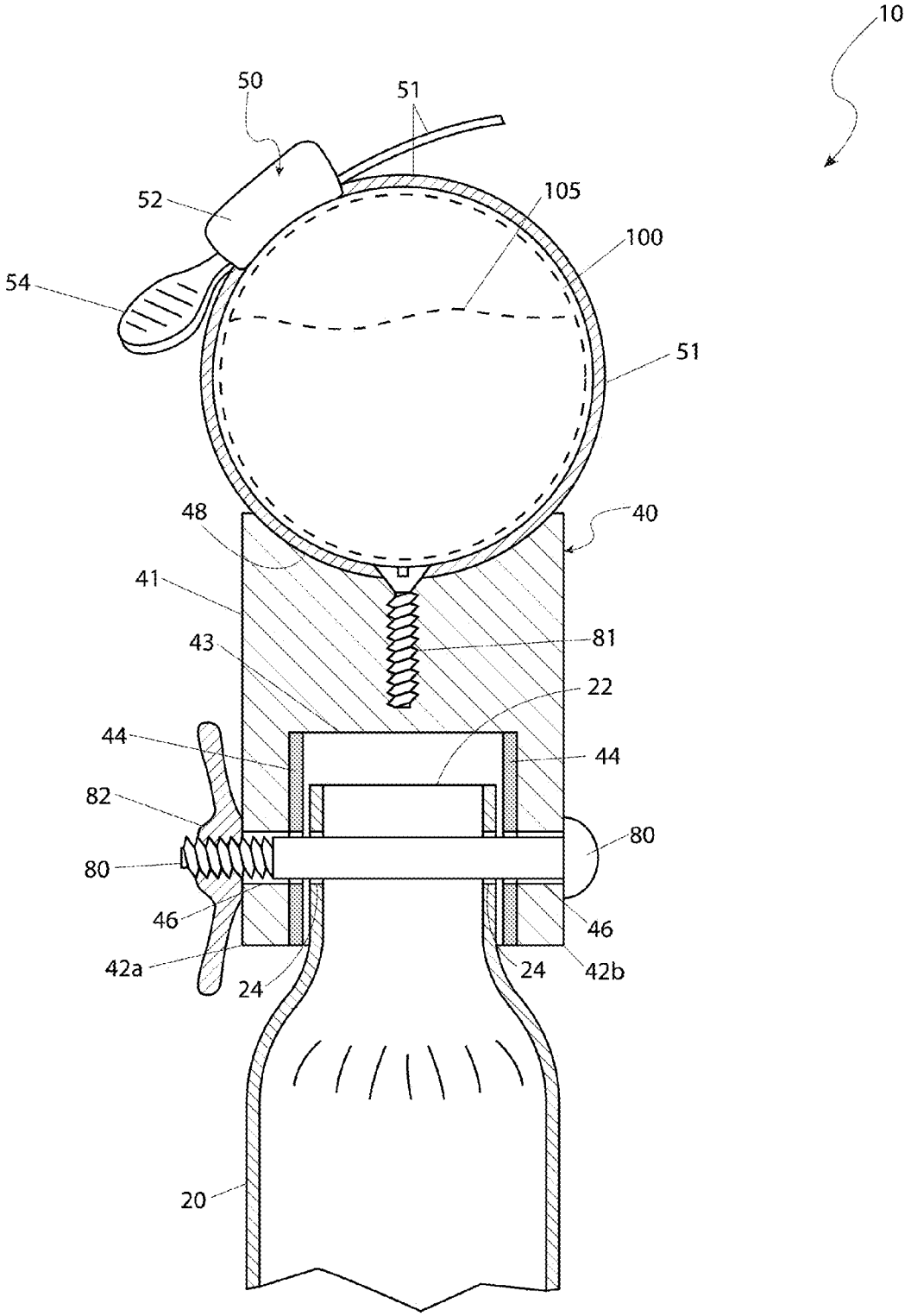

The best mode for carrying out the invention is presented in terms of its preferred embodiment, herein depicted within FIGS. 1 through 3. However, the invention is not limited to the described embodiment, and a person skilled in the art will appreciate that many other embodiments of the invention are possible without deviating from the basic concept of the invention and that any such work around will also fall under scope of this invention. It is envisioned that other styles and configurations of the present invention can be easily incorporated into the teachings of the present invention, and only one particular configuration shall be shown and described for purposes of clarity and disclosure and not by way of limitation of scope.

The terms "a" and "an" herein do not denote a limitation of quantity, but rather denote the presence of at least one of the referenced items.

The present invention describes a container holder 10 which aids in the self-application of compounds and fluids 105 to hard-to-reach areas of a user 110, such as the back 111. The container holder 10 is particularly well suited to containers 100 which are roll-on styled or sponge-tipped applicators.

Referring now primarily to FIG. 1, the container holder 10 includes a handle assembly 20 which is approximately two feet (2 ft.) long. Such a length is usually sufficient to reach all parts of a user's back 111. The handle assembly 20 includes an ergonomic hand grip 26 at a lower end 25 and a pivoting head assembly 40 having a circular clamp 50 at an upper end 22. The pivoting head assembly 40 allows positioning of a clamped container 100 straight up, straight down, or at any position in between.

Turning now primarily to FIG. 2, the pivoting head assembly 40 and its clamp 50 are dimensioned to enable encompassing and clamping the container 100. The clamp 50 comprises a clamp strap 51 which is tightened around the container 100 using a thumb screw 54. The container holder 10 can hold various circular or ovular-shaped containers 100, preferably including those comprising a sponge tip or a roll-on-type applicator. Such containers 100 may contain compounds and fluids 105 (see FIG. 3) such as, but not limited to: salves, lotions, topical ointments, prescription medications, and the like. The container holder 10 is especially useful when used by the elderly, disabled, those living alone, or anyone who would otherwise need assistance in reaching hard-to-reach areas of their body.

Returning now to FIG. 1, the hand grip 26 is envisioned as comprising dense closed-cell urethane foam that is formed into a cylinder and which is adhesively bonded to the lower end 25 of the handle 20. The hand grip 26 is configured to provide easy gripping of the handle 20 using one (1) hand 112 even when wet, such as when showering.

Referring now to FIGS. 2 and 3, the handle 20 is envisioned as being a round tubular member made of light-weight plastic or of a light-weight metal such as aluminum. The upper end 22 of the handle 20 is formed into a rectangular cross-section. This assists insertion and attachment of the pivoting head assembly 40 to the handle 20. As previously noted the pivoting head assembly 40 can rotate one-hundred eighty degrees (180°) relative to the elongation of the handle 20. This enables selective positioning of the clamped container 100 at any desired angle.

The pivoting head assembly 40 has an inverted "U"-shaped injection-molded plastic pivot body 41. The pivoting head assembly 40 also has a downwardly directed and parallel first leg 42*a* and second leg 42*b* which form a rectangular slot 43 in between. The top of the pivot body 41 forms a concave saddle 48. The clamp 50 is mounted at the center of the saddle 48 using a clamp fastener 80 such that the clamp 50 runs along the saddle's 48 concave contour.

The clamp 50 is envisioned as operating in a similar manner as a common screw-driven hose clamp and being capable of holding a circular container 100 having a diameter between approximately one to three inches (1-3 in.). To that end the clamp 50 includes the clamp strap 51, a clamp screw housing 52, and a thumb screw 54 for enabling easy tightening or loosening of the clamp strap 51 without tools.

The slot 43 is dimensioned to receive the upper end 22 of the handle 20. The handle 20 is rotatably attached in the slot 43 between the first leg 42*a* and the second leg 42*b* via a through-bolt type pivot fastener 81. A suitable pivot fastener 81 is a shoulder bolt. The pivot fastener 81 is inserted through aligned first apertures 24 of the handle 20 and through aligned second apertures 46 of the legs 42*a*, 42*b*. The pivot fastener 81 is secured using a wing nut 82. The wing nut 82 enables tightening the first leg 42*a* and the second leg 42*b* to pinch the upper end 22 of the handle 20. By loosening the wing nut 82 the pivoting head assembly 40 can pivot on the handle 20. Tightening the wing nut 82 locks the pivoting head assembly 40 relative to the handle 20.

Locking the angular position of the pivoting head assembly 40 is assisted by the incorporation of friction pads 44 that are adhesively bonded upon inward-facing surfaces of the first leg 42*a* and the second leg 42*b*. The friction pads 44 are comprised of a plastic or rubber material which helps the retention of the pivoting head assembly 40*a* to a position set by the user 110. The use of the friction pads 44 together with the wing nut 82 and pivot fastener 81 enables easy angular adjustment of the container holder 10 and ease of locking in place without use of tools or disassembly.

It is envisioned that other styles and configurations of the present invention can be easily incorporated into the teachings of the invention, and only one particular configuration shall be shown and described for purposes of clarity and disclosure and not by way of limitation of scope.

The preferred embodiment of the present invention can be utilized by the common user in a simple and effortless manner with little or no training. After initial purchase or acquisition of the container holder 10, it would be configured and utilized as indicated in FIG. 1.

The method of utilizing the container holder 10 may be achieved by performing the following steps: procuring the container holder 10; selecting a container 100 providing a desired fluid 105 that is to be applied; inserting the container 100 into the clamp strap 51 of the clamp 50; positioning the container 100 longitudinally within the clamp 50; securing the container 100 in position by tightening the clamp 50 around the container 100 using the thumb screw 54; grasping and tilting the container 100 upwardly or downwardly until obtaining a desired application angle of the container 100; grasping the hand grip 26 of the handle 20; grasping the hand grip 26 using one hand 112 and manipulating the clamped container 100 to contact a hard-to-reach area of the user's body 110; motioning the tip or applicator of the container 100 across a particular area of the user's 110 body such as the back 111 to apply the compound or fluid 105; repeating the described steps for any additional areas of the user's 110 body which require application; and, benefiting from an easily configurable means to apply compounds or fluids 105 upon hard-to-reach areas of a user's 110 body using the container holder 10.

It is further envisioned that the container holder 10 may also be utilized to hold containers 100 which provide various other liquids such as roll-on shoe polish, allowing a user 110 to quickly touch up footwear, without bending over or removing their shoes. Furthermore, the container holder 10 may be used to position various solid objects such as a dust mop handles, a piece of sidewalk chalk, and the like, enabling a user 110 to perform various other tasks.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated. It is understood that various omissions or substitutions of equivalents are contemplated as circumstance may suggest or render expedient, but is intended to cover the application or implementation without departing from the spirit or scope of the claims of the present invention.

What is claimed is:

1. A container holder, comprising:

an elongated handle having a first end and a rectangular cross-sectioned second end;

a hand grip attached to said first end;

a pivot fastener;

a pivoting head assembly having a body with a rectangular slot defined by a first leg and by a second leg, said body including a concave saddle opposite said rectangular slot;

a clamp attached to said body at said saddle;

wherein said pivot fastener passes through said first leg, said second leg, and said second end, thereby attaching said pivoting head assembly to said handle;

wherein said pivoting head can pivot if said pivot fastener is loose;

wherein said pivoting head is locked if said pivot fastener is tight; and, wherein said pivot fastener causes said first leg and said second leg to pinch said second end when tightened.

2. The container holder according to claim 1, wherein said handle is approximately two feet long.

3. The container holder according to claim 1, wherein said hand grip includes closed-cell urethane foam.

4. The container holder according to claim 1, wherein said hand grip is adhesively bonded to said handle.

5. The container holder according to claim 1, wherein said handle includes aluminum.

6. The container holder according to claim 1, wherein said pivoting head assembly can pivot 180° degrees relative to said handle.

7. The container holder according to claim 1, wherein said clamp is screwed onto said body.

8. The container holder according to claim 7, wherein said clamp includes a clamp strap, a clamp screw housing attached to one end of said clamp strap and receiving the other end of said clamp strap, and a thumb screw for tightening said clamp strap.

9. The container holder according to claim 8, wherein said clamp strap extends along said saddle.

10. The container holder according to claim 1, further including a wing nut attached to said pivot fastener, said wing nut for selectively tightening said pivot fastener.

11. A container holder, comprising:

an elongated handle having a first end and a rectangular cross-sectioned second end;

a foam hand grip attached to said first end;

a screw pivot fastener having a wing nut;

a pivoting head assembly having a body with a rectangular slot defined by a first leg and by a second leg, said body formed to have a concave saddle surface opposite said rectangular slot;

a clamp attached to said body at said saddle surface, said clamp extending along said saddle surface;

wherein said pivot fastener passes through said first leg, said second leg, and said second end, thereby attaching said pivoting head assembly to said handle;

wherein said pivoting head can pivot if said wing nut is loose;

wherein said pivoting head is locked if said wing nut is tight; and, wherein said pivot fastener causes said first leg and said second leg to pinch said second end when tightened.

12. The container holder according to claim 11, wherein said handle is approximately two feet long.

13. The container holder according to claim 11, wherein said hand grip includes closed-cell urethane foam.

14. The container holder according to claim 13, wherein said hand grip is adhesively bonded to said handle.

15. The container holder according to claim 11, wherein said handle includes aluminum.

16. The container holder according to claim 11, wherein said pivoting head assembly can pivot 180° degrees relative to said handle.

17. The container holder according to claim 11, wherein said clamp is screwed onto said body.

18. The container holder according to claim 17, wherein said clamp includes a clamp strap, a clamp screw housing attached to one end of said clamp strap and receiving the other end of said clamp strap, and a thumb screw for tightening said clamp strap.

* * * * *